US006530315B1

(12) United States Patent
Hartmann

(10) Patent No.: US 6,530,315 B1
(45) Date of Patent: Mar. 11, 2003

(54) DIAPHRAGM OF A DIAPHRAGM PRESS FOR SEPARATING LIQUID AND SOLID SUBSTANCES

(75) Inventor: Eduard Hartmann, Schneisingen (CH)

(73) Assignee: Bucher-Guyer AG, Niederweningen (CH)

( * ) Notice: Subject to any disclaimer, the term of this patent is extended or adjusted under 35 U.S.C. 154(b) by 0 days.

(21) Appl. No.: 09/600,272

(22) PCT Filed: Nov. 17, 1999

(86) PCT No.: PCT/CH99/00542

§ 371 (c)(1),
(2), (4) Date: Jul. 19, 2000

(87) PCT Pub. No.: WO00/30841

PCT Pub. Date: Jun. 2, 2000

(30) Foreign Application Priority Data

Nov. 25, 1998 (CH) ..... 2345/98

(51) Int. Cl.[7] ..... B30B 5/02; B30B 9/02

(52) U.S. Cl. ..... 100/211; 100/107; 100/110; 100/116; 100/126; 100/269.02; 100/269.04; 92/98

(58) Field of Search ..... 100/107, 211, 100/269.02, 269.03, 269.04, 126, 116, 110; 92/98

(56) References Cited

U.S. PATENT DOCUMENTS

| | | | | |
|---|---|---|---|---|
| 4,438,690 A | * | 3/1984 | von Allworden | 100/116 |
| 4,516,490 A | | 5/1985 | Hartmann | 100/107 |
| 4,607,570 A | | 8/1986 | Hauser | 100/116 |
| 5,054,952 A | * | 10/1991 | Chara | 403/326 |
| 5,176,074 A | | 1/1993 | Hartmann | 100/116 |
| 5,349,896 A | * | 9/1994 | Delany, III et al. | 92/98 R |
| 5,355,790 A | | 10/1994 | Hartmann | 100/211 |
| 5,560,279 A | * | 10/1996 | Connors et al. | 92/5 R |

FOREIGN PATENT DOCUMENTS

| | | |
|---|---|---|
| DE | 10 12 527 | 7/1957 |
| DE | 41 31 324 | 3/1993 |
| FR | 2 686 226 | 7/1993 |
| WO | 2 176 504 | 12/1986 |

* cited by examiner

*Primary Examiner*—Allen Ostrager
*Assistant Examiner*—Jimmy Nguyen
(74) *Attorney, Agent, or Firm*—Burns, Doane, Swecker & Mathis, L.L.P.

(57) ABSTRACT

In a diaphragm (3) of a diaphragm press for separating liquid and solid materials by action of a pressure medium on the materials (7) via the diaphragm (3), the functions of sealing and retention are separated. This is accomplished by a dual embodiment of the diaphragm (3) in the form of a substantially sealing diaphragm seal (14) and a substantially retaining diaphragm carrier (13). A force transmission from drainage elements (6) in the press chamber (4) of a pressing vessel (1) of the diaphragm press to the diaphragm (3) can be accomplished by the diaphragm carrier (13) in a manner that treats the material gently. This substantially improves the service life of the diaphragm (3).

8 Claims, 4 Drawing Sheets

DIAPHRAGM OF A DIAPHRAGM PRESS FOR SEPARATING LIQUID AND SOLID SUBSTANCES

Figure 1:
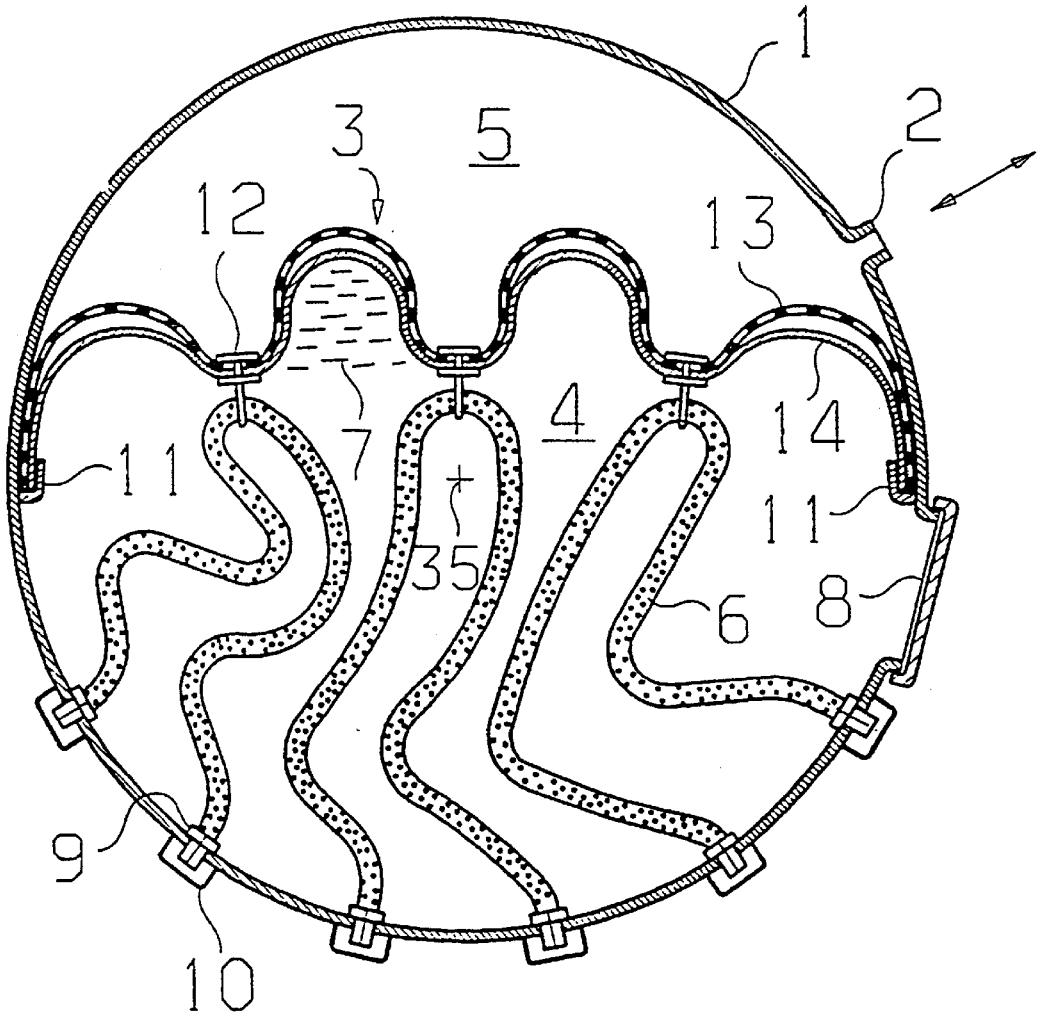

The invention relates to a diaphragm of a diaphragm press for separating liquid and solid materials by action of a flowable pressure medium on the materials via the diaphragm, which is fastened in a pressing vessel of the press and divides this pressing vessel into a pressure chamber and a press chamber.

A membrane (also called a diaphragm) of a press intended for separating liquid and solid materials is known from Swiss Patent Application CH-A 686 93 (Bucher-Guyer). This membrane is fastened in a cylindrical pressing vessel of the press between a pressure chamber and a press chamber, parallel to the cylinder axis. The membrane is shaped in tub-like fashion and comprises two semicircular membrane parts, oriented toward the face ends of the pressing vessel, and one middle part, connected to the other two parts on both sides and corresponding to approximately half of the jacket of the vessel.

The membrane parts are built up from a fabric coated with plastic on both sides. The semicircular membrane parts are divided up into segments, and the filament systems of the fabric in each segment are oriented parallel to the radially extending bisector of the respective segment. This achieves improved dimensional stability in the radial main loading directions and prevents destruction of the connection between the fabric and the coating.

However, the service life of such known membranes is not satisfactory and is a primary reason for the only limited spread of the membrane presses in question. The membrane material used is a polyester fabric coated on both sides with a cross-linked polyurethane. It is the action of drainage elements suspended from the membranes that has a substantial influence on the service life of the membranes. In retraction processes of the membrane in the press under a vacuum and when the material being pressed is loosened up, major forces are introduced to the membrane via these drainage elements. These forces lead to severe tensile and shear stresses.

Damage patterns of membranes show a separation of the coating from the fabric, with bubbles being formed. As soon as one of the bubbles pops, the membrane becomes leaky and must then be repaired or replaced entirely.

The object of the invention is to overcome these disadvantages of the known membranes by means of a novel embodiment.

According to the invention, this object is attained in a diaphragm of the type defined at the outset by a dual embodiment comprising two parts, both of which extend over the entire diaphragm area and are solidly connected to one another at only a number of separate connection points on the diaphragm area, and of which one part has essentially only a sealing function, while the other part has essentially only a retention function.

The diaphragm is preferably embodied such that the part with the sealing function is disposed toward the press chamber, and the part with the retention function is disposed toward the pressure chamber, and that at the separate connection points of these parts, connecting elements are provided, which have means for anchoring flexible, ropelike drainage elements, which extend through the press chamber between the diaphragm and a jacket of the pressing vessel of the press. Advantageously, the part having the sealing function is embodied as a cloth of homogeneous rubber or cross-linked polyurethane, with a thickness adequate for the requisite stability, and that the part having the retention function is embodied as a cloth of gas-permeable, non-coated high-strength woven polyamide fabric. The part having the retention function includes a multiaxial filament cluster or network of a plurality of filament systems.

Further variants of the diaphragm are defined by the claims.

Figure 2:
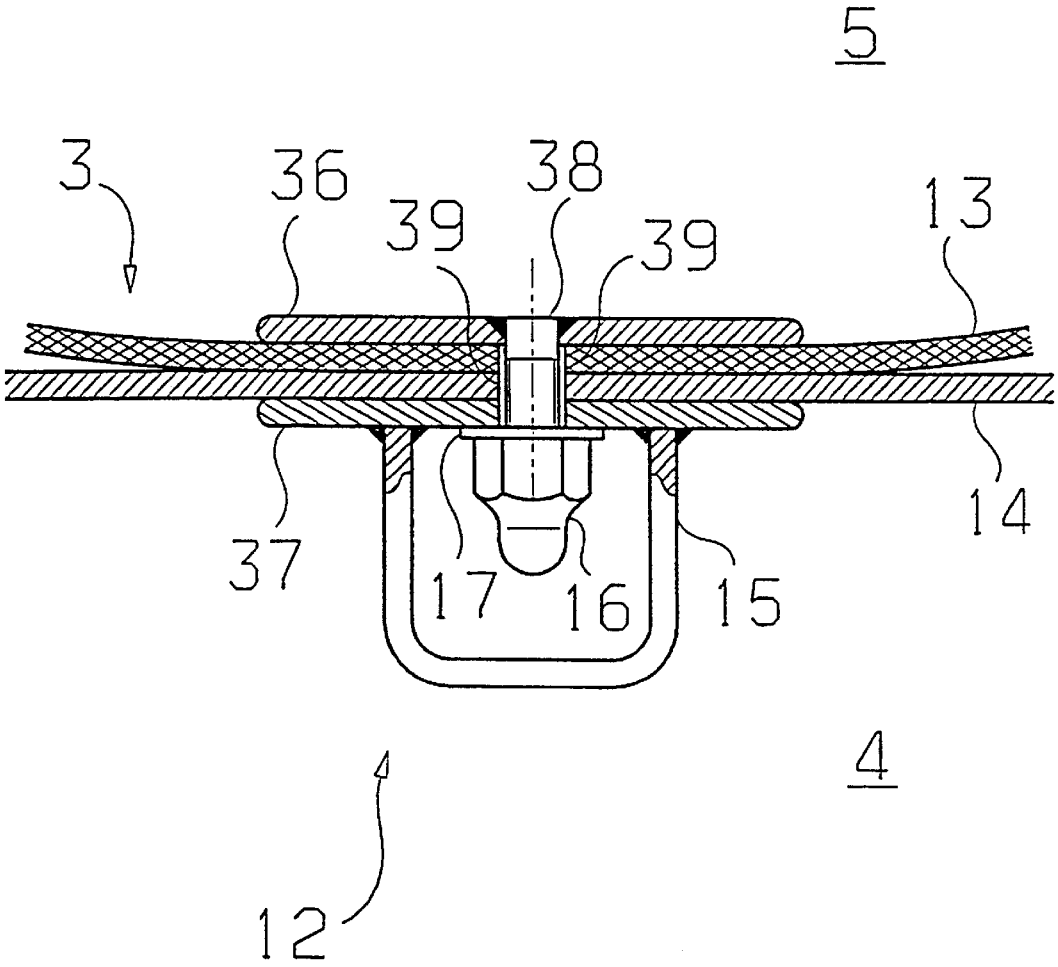
Figure 3:
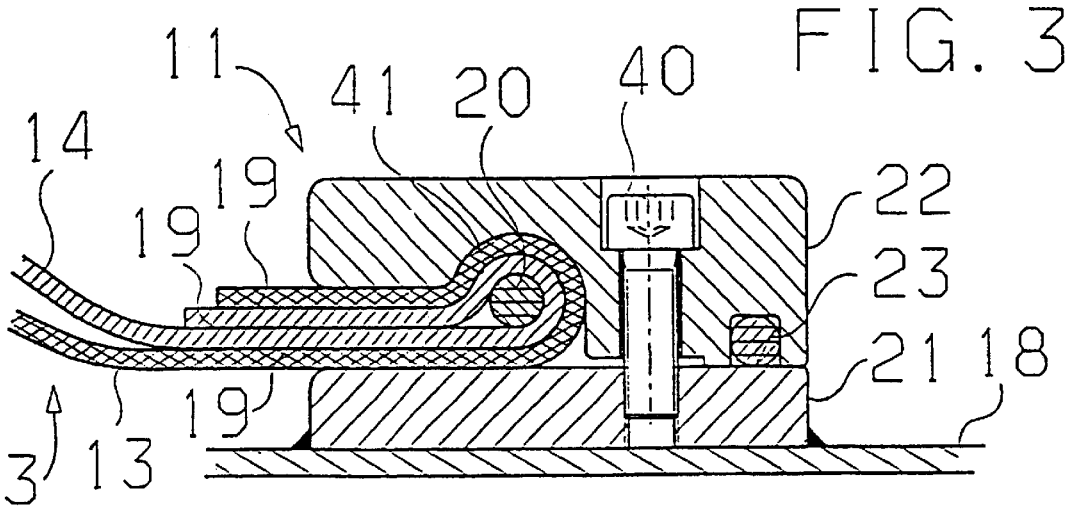
Figure 4:
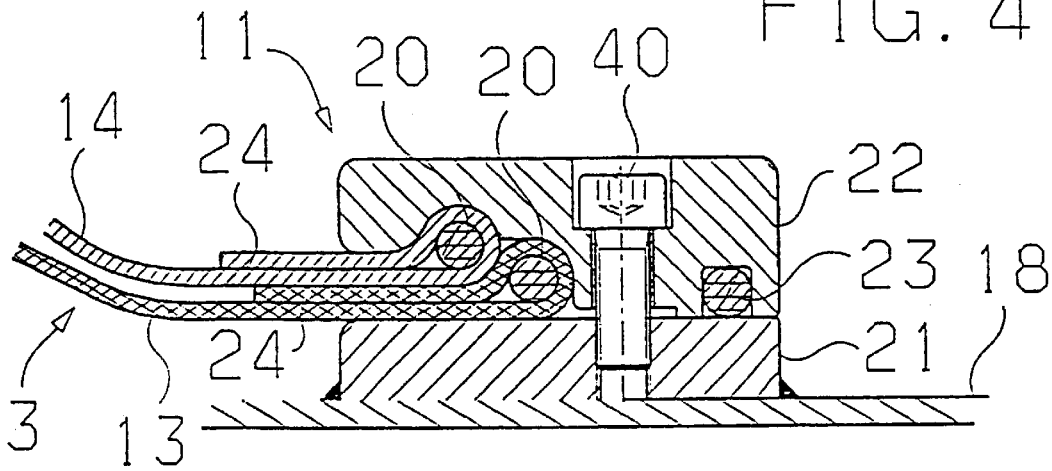
Figure 5:
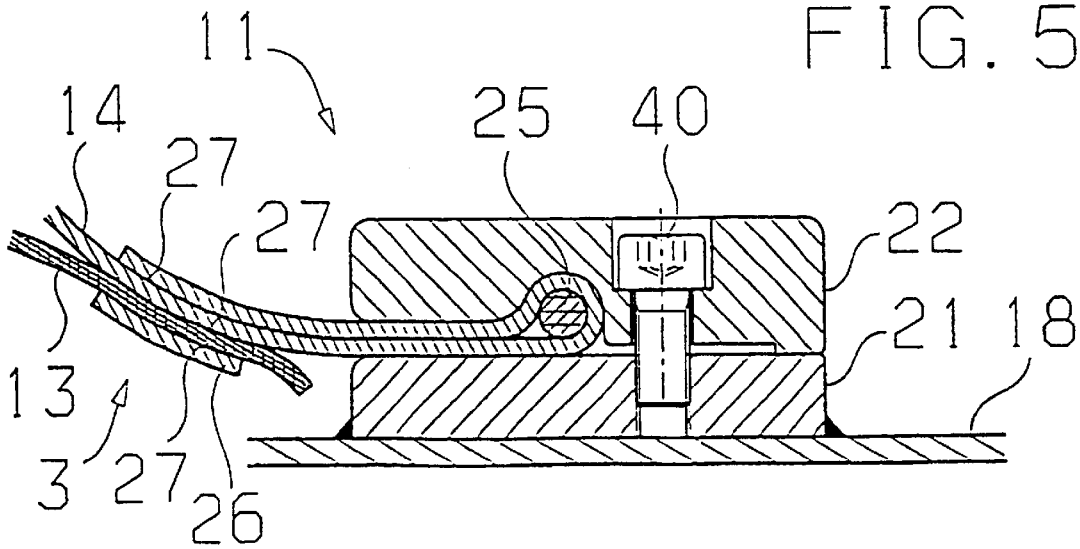
Figure 6:
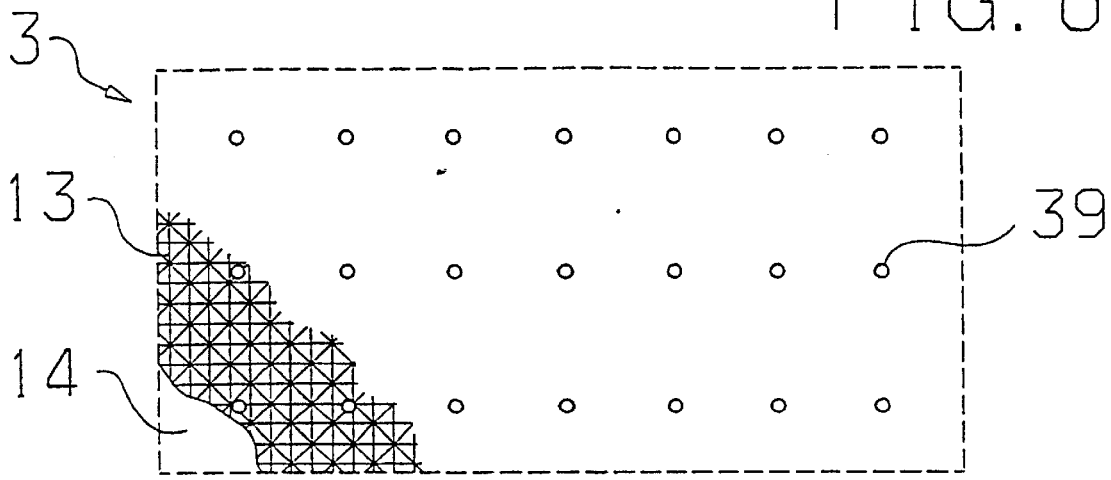
Figure 7:
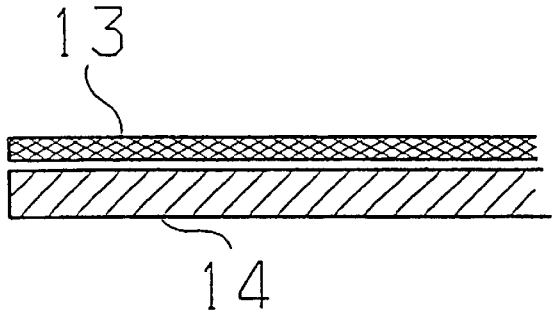
Figure 8:
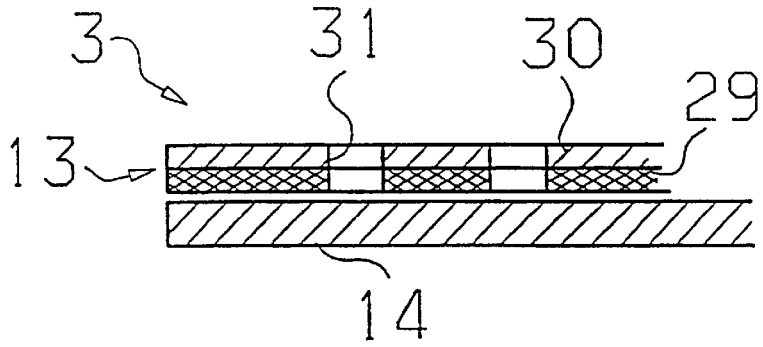
Figure 9:
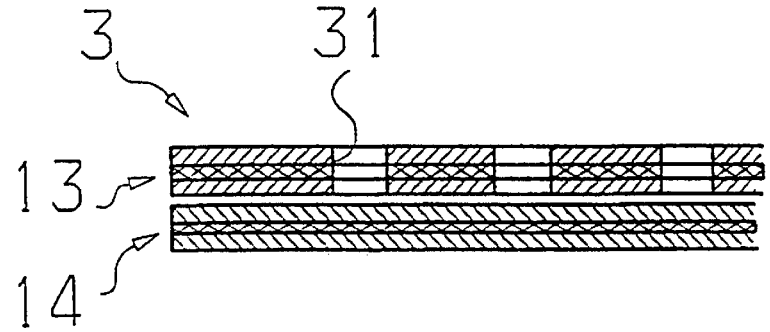

Exemplary embodiments of the invention are described in further detail in the ensuing description and in the drawing figures. Shown are:

FIG. 1, in cross section, a cylindrical pressing vessel of a diaphragm press with a press diaphragm according to the invention;

FIG. 2, a connecting element for anchoring a drainage element to the press diaphragm of FIG. 1, shown in detail;

FIG. 3, fastening the press diaphragm of FIG. 1 by its edge to the jacket of the pressing vessel by beading and clamping of the two parts;

FIG. 4, a variant of the fastening shown in FIG. 3, with beading of each part over a respective flexible cord;

FIG. 5, a variant of the fastening of FIG. 3 with beading of the sealing part of the press diaphragm and welding of the retention part to the sealing part;

FIG. 6, a detail of the press diaphragm of the invention, in plan view;

FIG. 7, a cross section through two parts of a press diaphragm of the invention;

FIG. 8, a cross section through a variant of the press diaphragm with a retention part that is plastic-coated on one side but is gas-permeable; and FIG. 9, a cross section through a variant of the press diaphragm with a retention part coated with plastic on both sides, with air openings.

FIG. 1, in cross section, shows a cylindrical pressing vessel 1 of a diaphragm press of a type known per se, not all of whose other parts are shown. The pressing vessel 1 is supported rotatably about its longitudinal axis 35. In the interior of the pressing vessel 1, along two diametric jacket lines and the diameter lines connecting them of the bottom and top parts, a press diaphragm 3 is tightly fastened by its edge, by means of fastening elements 11. The shape of the press diaphragm 3 is selected to be tub-like, such that it divides the pressing vessel 1 into a press chamber 4 and a pressure chamber 5, but in a stretched state it can press against the inside face of the pressing vessel 1.

As FIG. 1 shows, the press diaphragm 3 comprises two parts 13, 14, of which the part 13 toward the pressure chamber has primarily a retention function and the part 14 toward the press chamber has primarily a sealing function. As a symbolically represented connection 2 for compressed air and a vacuum indicates, the pressure chamber 5 can be acted upon by a pressure medium. In practice, the delivery of the pressure medium is done in a known manner via an axial rotary guide, not shown here. A delivery of material 7 for pressing to the press chamber 4 is also done via an axial inlet, not shown, or via a tank cap 8, once this cap 8 has been rotated upward.

The tank cap 8 is also used to evacuate the cake and serves as a manhole. Extending between the press diaphragm 3 and the wall toward the press chamber of the pressing vessel 1 are drainage elements 6, which include a flexible core with drainage grooves for expressed liquids, such as fruit juice, as well as a surrounding textile filter. The drainage elements 6 communicate on the one hand, via fast-action closures 9, with juice collection channels 10 that discharge into a collection line, not shown. On the other hand, the drainage elements 6 communicate with the press diaphragm 3 via connecting elements 12. The drainage elements 6 are long enough that when the press chamber 4 is filled with a material 7 to be pressed, such as fruit mash, they can follow the press diaphragm 3 as it retracts as far as the inside face, toward the pressure chamber, of the pressing vessel 1.

The press diaphragm 3 accordingly has the following functions in operation of the diaphragm press: air-tight separation of the press chamber 4 from the pressure chamber 5; retention of the drainage elements 6; and retraction and tensing of the drainage elements 6 in the press cake of the material 7 to be pressed during loosening and evacuation operations. In accordance with these functions, the press diaphragm is embodied in dual fashion of a diaphragm carrier 13 and a diaphragm seal 14. In the exemplary embodiment of FIG. 1, the diaphragm carrier 13 comprises a gas-permeable high-strength flexible material with little elongation under tension. The diaphragm carrier 13 transmits the forces between the connecting elements 12 and the drainage elements 6. At the same time, upon retraction of the press diaphragm 3 in a vacuum in the pressure chamber 5 against the wall of the pressing vessel 1, the diaphragm carrier 13 protects the diaphragm seal 14 from the incident sliding and friction events between the diaphragm 3 and the wall.

In the exemplary embodiment of FIG. 1, the diaphragm seal 14 comprises a single- or multi-layer flexible gas-tight plastic or rubber cloth, with or without textile reinforcement. The diaphragm seal 14, by comparison with the diaphragm carrier 3, under the same tensile stress has a greater elastic elongation.

As FIG. 1 shows, the diaphragm carrier 13 and diaphragm seal 14 are joined to one another both at the connecting elements 12 for the drainage elements 6 and at the fastening elements 11 at the edge. The diaphragm carrier 13 prevents overelongation and damage of the diaphragm seal 14 under the influence of forces via the drainage elements 6 in operation of the diaphragm press. The forces exerted on the diaphragm seal 14 as a consequence of the pressure difference between a vacuum in the pressure chamber 5 and the press chamber 4 are introduced into the drainage elements 6 from the diaphragm seal 14 via the diaphragm carrier 13 and the connecting elements 12.

FIG. 2 shows one of the connecting elements 12 for anchoring a drainage element 6 to the press diaphragm 3 of FIG. 1, in detail. The diaphragm carrier 13 is joined together with the diaphragm seal 14, each through a respective hole 39, by means of holder plates 36, 37 and a screw 38 with a nut 16. Between the nut 16 and the holder plate 37, a sealing disk 17 is provided, for sealing between the pressure chamber 5 and the press chamber 4. The holder plate 37 has a bracket 15, with which a drainage element 6 is connected in accordance with FIG. 1, either directly or via a flexible element.

FIG. 3 shows a version of the fastening element 11 for the edge of the press diaphragm 3 on a wall 18 of the pressing vessel 1 in a more-detailed cross section corresponding to FIG. 1. A clamping strip 21 is mounted along the wall 18, and a slender clamping tab 22 is screwed by screws 40 to the clamping strip. The edge of the press diaphragm 3 composed of the diaphragm carrier 13 and the diaphragm seal 14 is beaded over a flexible cord 20, such as a rope or a round rubber band, to form a bead 41. The bead 41 is fixed between the clamping strip 21 and the clamping tab 22. The diaphragm parts 13 and 14 are glued, welded or stitched to one another in regions 19. Since the diaphragm carrier 13 is not gas-tight, a seal 23 is inserted between the clamping strip 21 and the clamping tab 22. This fastening extends uninterruptedly along the entire edge of the press diaphragm 3.

FIG. 4 shows a variant of the fastening of FIG. 3, and identical reference numerals indicate corresponding components. In this variant, each of the two diaphragm parts 13 and 14 is beaded over its own flexible cord 20. Thus the clamping tab 22 is embodied for clamping two cords 20. Welding of the diaphragm parts 13, 14 to one another as in FIG. 3 is avoided in the version of FIG. 4; instead, each diaphragm part 13 and 14 is welded separately at regions 24.

FIG. 5 shows a further variant of the fastening of FIG. 3, in which the same reference numerals indicate corresponding components. In this variant, only the diaphragm seal 14 is fastened by beading about a cord 25 between the clamping strip 21 and the clamping tab 22. Here, the diaphragm carrier 13 is welded and/or stitched, with an auxiliary strip 26, to the diaphragm seal 14 at regions 27. Since the diaphragm seal 14 is gas-tight, the seal 23 of FIG. 3 between the clamping strip 21 and the clamping tab 22 of FIGS. 3 and 4 is missing here.

FIG. 6 shows a detail of a press diaphragm 3 according to the invention and as shown in FIG. 1, in plan view. All that can be seen of the diaphragm seal 14 is its lower left corner, because the diaphragm carrier 13, shown as a multiaxial network and located above it, covers the rest of the diaphragm seal 14. Both diaphragm parts 13, 14 have a plurality of continuous holes 39, of the type shown in FIG. 2, at which the connecting elements 12 for anchoring the drainage elements 6 to the press diaphragm 3 are fastened. Although the detail of FIG. 6 is flat, the entire press diaphragm 3 actually has a tub-like shape of the type described in conjunction with FIG. 1.

FIG. 7, in a cross section, shows a detail of two parts 13, 14, one above the other, of a press diaphragm according to the invention as shown in FIG. 1. The two parts 13, 14 are joined to one another only by the fastening elements 11, not shown here, at the edge and by the connecting elements 12 of FIG. 1. The diaphragm carrier 13 is shown here as an open, gas-permeable textile fabric. It can also be embodied as a multiaxially linked rope cluster.

In a variant of the press diaphragm of FIG. 7, shown in FIG. 8, the diaphragm carrier 13 comprises a textile fabric 29, which is coated on one side with a plastic 30. To make the diaphragm carrier 13 gas-permeable, in addition to the holes 39 for the connecting elements 12 of FIG. 2, many further holes 31 are disposed in the diaphragm carrier 13. As in FIG. 7, the diaphragm seal 14 is embodied as a homogeneous cloth of plastic or rubber. Coating the diaphragm carrier 13 with a plastic 30 reduces the wear effect upon functionally dictated friction of the diaphragm carrier 13 at the wall of the pressing vessel 1.

A further variant, shown in FIG. 9, of the press diaphragm of FIG. 7 shows a fabric, coated with plastic on both sides and with air holes 31, as the diaphragm carrier 13. Once again, the diaphragm seal 14 is embodied as a textile fabric coated on both sides, but without air holes. As already mentioned above, the attainable elongation of the diaphragm seal 14 under tension is greater than that of the diaphragm carrier 13, so that the incident tensile forces at the connecting elements 12 will be transmitted predominantly by the diaphragm carrier 13. With this version, overstressing of the diaphragm seal can be prevented in all the exemplary embodiments shown in FIGS. 1–9.

What is claimed is:

1. A diaphragm of a diaphragm press for separating liquid and solid materials (7) by action of a flowable pressure medium on the materials via the diaphragm, which is fastened in a pressing vessel (1) of the press and divides this pressing vessel into a pressure chamber (5) and a press chamber (4), said diaphragm comprising two parts (14, 13), both of which extend over the entire diaphragm area and are solidly connected to one another at only a number of separate connection points (39) on the diaphragm area, and of which one part (14) has essentially only a sealing function, while the other part (13) has essentially only a retention function, wherein the part (14) with the sealing function is disposed toward the press chamber and the part (13) with the retention function is disposed toward the pressure chamber, and wherein at the separate connection points (39) of these parts (14, 13), connecting elements (12) are provided, which have means (15) for anchoring flexible, ropelike drainage elements (6), which extend through the press chamber (4) between the diaphragm (3) and a jacket (18) of the pressing vessel of the press, and wherein the part with the retention function comprises a gas-permeable high-strength flexible material with little elongation under tension and the part with the sealing function comprises a flexible gas-tight plastic or rubber cloth, with or without textile reinforcement.

2. The diaphragm of claim 1, characterized in that under an equal load, the part (14) having the sealing function, exhibits an actual and allowable elongation that is substantially greater than the allowable elongation of the part (13) having the retention function.

3. The diaphragm of claim 2, characterized in that the part (13) having the retention function is embodied as a cloth of gas-permeable, non-coated high-strength woven polyamide fabric.

4. The diaphragm of claim 3, characterized in that the part (13) having the retention function includes a multiaxial filament cluster or network of a plurality of filament systems.

5. The diaphragm of claim 2, characterized in that the part (13) having the retention function is embodied as a diaphragm carrier (29), coated with a plastic (30) on one side, which as a consequence of many further holes (31) in addition to holes (39) for anchoring the drainage elements (6) is gas-permeable.

6. The diaphragm of claim 2, characterized in that the part (14) having the sealing function is embodied as a textile fabric coated with a plastic on both sides.

7. The diaphragm of claim 1, characterized in that its edge has a substantially rectangular shape; that the connection points (39) have a regular arrangement oriented toward the edges of the rectangle; and that the two parts (14, 13), in the interior of the pressing vessel (1), are fastened by their edges to the vessel jacket (18) by being beaded over at least one flexible cord (20, 25) and by clamping of the bead by means of clamping strips (21, 22) screwed to the vessel jacket.

8. The diaphragm of claim 2, characterized in that the part (14) having the sealing function is embodied as a cloth of homogeneous rubber or cross-linked polyurethane.

* * * * *